United States Patent [19]

Lacy

[11] 4,148,673

[45] Apr. 10, 1979

[54] PLATE QUENCHING METHOD

[75] Inventor: John P. Lacy, Baytown, Tex.

[73] Assignee: United States Steel Corporation, Pittsburgh, Pa.

[21] Appl. No.: 446,448

[22] Filed: Feb. 27, 1974

Related U.S. Application Data

[62] Division of Ser. No. 230,417, Feb. 29, 1972, abandoned.

[51] Int. Cl.[2] ..... C21D 9/00

[52] U.S. Cl. ..... 148/153; 148/131; 148/157

[58] Field of Search ..... 148/143, 145, 153, 157, 148/131

[56] References Cited

U.S. PATENT DOCUMENTS

| | | | |
|---|---|---|---|
| 3,423,254 | 1/1969 | Safford et al. | 148/153 |
| 3,546,911 | 12/1970 | Lenz | 148/153 |
| 3,756,869 | 9/1973 | Melloy et al. | 148/143 |

*Primary Examiner*—R. Dean

*Attorney, Agent, or Firm*—Walter P. Wood

[57] ABSTRACT

A method and apparatus for quenching steel plates after they come from an austenitizing furnace. The plates are stopped and their surfaces flooded with large volumes of water applied almost instantaneously. The valves which control water application are operated by pneumatic operators so that they move from a closed position to a full open position almost instantaneously. The invention overcomes the tendency of plates to buckle during quenching and cools the plate at the maximum rate for the water pressure and volume available.

3 Claims, 1 Drawing Figure

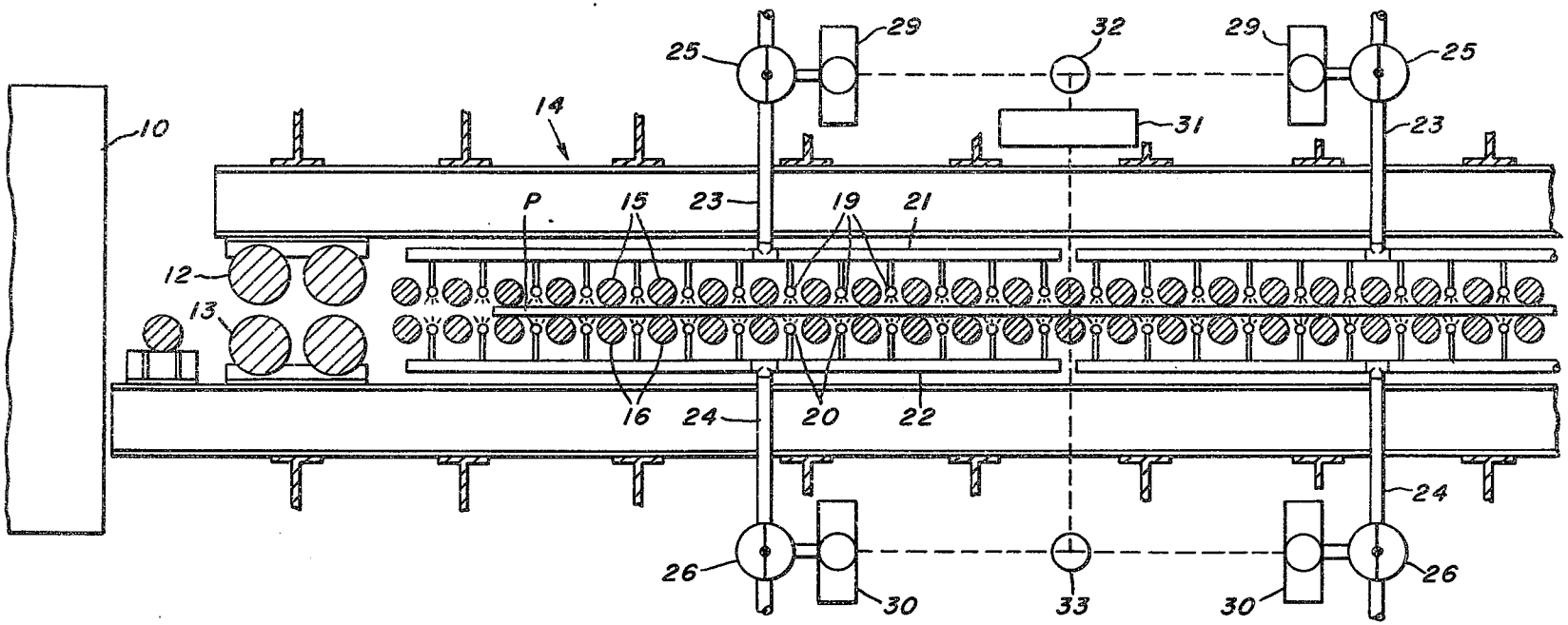
10
12
13
14
15
16
19
20
21
22
23
24
25
26
29
30
31
32
33
P

PLATE QUENCHING METHOD

This is a division of application Ser. No. 230,417, filed Feb. 29, 1972, abandoned.

This invention relates to an improved method and apparatus for quenching steel plates.

Conventional practice in processing steel plates is to heat the plate to an austenitizing temperature within a suitable furnace, remove the plate from the furnace, and immediately quench the plate to produce a martensitic structure throughout. Quenching procedures used heretofore successfully produce the desired martensitic structure, but tend to buckle or warp thinner plates, for example, those of a thickness of about 3/16 to 1½ inches. Such plates often require leveling to achieve commercial flatness.

An object of my invention is to provide an improved quenching method and apparatus which produce plates of martensitic structure yet avoid buckling or warping the plate.

A more specific object is to provide an improved quenching method and apparatus in which the plate is flooded with water top and bottom almost instantaneously, but with the top and bottom water application controlled to avoid either a crowned or a dished plate.

In the drawing:

The single FIGURE is a diagrammatic vertical sectional view of a quenching apparatus constructed in accordance with my invention.

The drawing shows a conventional roller hearth furnace 10 in which a series of steel plates P are heated throughout to an austenitizing temperature, usually above 1500° F. On leaving the furnace, the plates travel horizontally between top and bottom receiving rolls 12 and 13 and thence into a quenching apparatus 14. The latter includes top and bottom roller beds 15 and 16. The vertical spacing of the receiving rolls and of the roller beds is adjusted in accordance with the plate thickness to confine the plates closely. The receiving rolls and at least some of the rolls of the roller beds are driven for propelling the plates after they leave the furnace. The drive to the rolls of the roller beds is reversible to enable a plate supported between the roller beds to be moved back and forth.

The quenching apparatus 14 includes top and bottom spray manifolds 19 and 20 which lie between the rolls of the respective roller beds 15 and 16. Quench water is supplied to the manifolds through top and bottom sectional headers 21 and 22, and top and bottom inlet pipes 23 and 24, which lead to a water source. The inlet pipes contain normally closed valves 25 and 26. The parts of the quenching apparatus thus far described are similar to corresponding parts shown in Safford et al U.S. Pat. No. 3,423,254, and reference can be made thereto for a more complete showing.

In accordance with my invention, I equip valves 25 and 26 with pneumatically actuated fast-opening valve operators 29 and 30 respectively. I control these valve operators from a pulpit 31, as indicated schematically in the drawing. The connections between the control in the pulpit and the valve operators 29 and 30 include adjustable timing devices 32 and 33. The valve operators are of a known type which can throw the valves from a closed position to a full-open position almost instantaneously. The timing devices are of a known type which can delay operation of either the top valves or the bottom valves one-half to 5 seconds from the moment I operate the control in the pulpit. Since valve operators and timing devices which have such capability are known per se, I have not included a detailed description. One example of a suitable valve operator available commercially is the "Robotarm Actuator" sold by Bettis Corporation, Houston, Tex. One example of a suitable timer available commercially is sold by ATC Company, King of Prussia, Pennsylvania.

According to my quenching method, I stop the plate P when it is fully within the quenching apparatus 14 and closely confined. I operate the control in the pulpit 31 to flood both top and bottom surfaces with water which comes on full volume almost instantaneously as a result of the quick-opening characteristics of the valve operators 29 and 30. The full volume of water is sustained until the plate is quenched cold throughout. The water volume is in the range of about 15 to 20 gallons per square foot per minute on the top surface and an equal volume on the bottom surface. As I apply the quench water, I operate the roller beds 15 and 16 of the quenching apparatus to move the plate slowly back and forth. I control the flatness of the plate by setting the timing devices 32 and 33. If plates show a tendency to crown, I set the top timing device 32 to delay slightly the opening of the top valves 25. If the plates show a tendency to dish, I set the bottom timing device 33 to delay slightly the opening of the bottom valve 26. This relation is the opposite of what might be expected if the plate were not closely confined between the two roller beds 15 and 16.

To produce plates which have commercially acceptable flatness, as well as a desired martensitic structure throughout, it is critical to flood both top and bottom surfaces of the plate with large volumes of water applied almost instantaneously. This necessitates the use of quick-acting valve operators, instead of motors which do not open the valves quickly enough. To prevent the plate from crowning or dishing, it is necessary to provide means for delaying slightly the opening of the valves at the top or bottom as the case may be. I avoid any progressive application of quenching sprays, or the use of a preliminary high-intensity spray, as has been the practice in the prior art, since such sprays worsen the flatness problem. My method and apparatus are particularly useful for quenching relatively thin alloy steel plates (3/16 or ⅜ inch thick), where it is most difficult to produce plates of proper flatness. Nevertheless, my invention is not thus limited, but may be applied to plain carbon steel plates or to plates of greater thickness.

I claim:

1. In an operation in which a steel plate comes from a furnace heated throughout to an austenitizing temperature and passes into a quenching apparatus, an improved method of quenching said plate to produce commercial flatness in the plate as well as a martensitic structure throughout, said method comprising stopping the plate within said apparatus, flooding the top and bottom surfaces of the plate with large volumes of water applied almost instantaneously, but delaying the application of water to one of the surfaces of the plate slightly with respect to the other to prevent the plate from crowning or dishing, and moving the plate back and forth within said apparatus while the water is applied thereto.

2. A method as defined in claim 1 in which the water volume is about 15 to 20 gallons per square foot per minute on the top surface and an equal volume on the bottom surface.

3. A method as defined in claim 1 in which any preliminary application of water before the flooding is avoided.

* * * * *